US007273353B2

(12) United States Patent
Dube et al.

(10) Patent No.: US 7,273,353 B2
(45) Date of Patent: Sep. 25, 2007

(54) SHROUD HONEYCOMB CUTTER

(75) Inventors: Bryan P. Dube, Columbia, CT (US); Richard H. Page, Guilford, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/503,779

(22) Filed: Aug. 14, 2006

(65) Prior Publication Data

US 2007/0053778 A1 Mar. 8, 2007

Related U.S. Application Data

(63) Continuation-in-part of application No. 10/774,824, filed on Feb. 9, 2004, now Pat. No. 7,094,023.

(51) Int. Cl.
*F01D 11/12* (2006.01)

(52) U.S. Cl. ..... 416/192; 415/173.6

(58) Field of Classification Search ..... 416/192; 415/173.6

See application file for complete search history.

(56) References Cited

U.S. PATENT DOCUMENTS

| | | | | |
|---|---|---|---|---|
| 6,491,498 | B1 | 12/2002 | Seleski et al. | |
| 6,805,530 | B1 * | 10/2004 | Urban | 415/173.6 |
| 6,890,150 | B2 * | 5/2005 | Tomberg | 415/173.4 |
| 6,913,445 | B1 * | 7/2005 | Beddard et al. | 416/192 |
| 2005/0175453 | A1 | 8/2005 | Dube et al. | |
| 2005/0191182 | A1 * | 9/2005 | Seleski | 416/192 |

FOREIGN PATENT DOCUMENTS

| | | | |
|---|---|---|---|
| EP | 1561904 | A2 | 8/2005 |
| JP | 08-303204 | A | 11/1996 |

* cited by examiner

*Primary Examiner*—Richard A. Edgar
(74) *Attorney, Agent, or Firm*—Bachman & LaPointe

(57) ABSTRACT

A turbine blade for use in a gas turbine engine is provided. The turbine blade includes an airfoil portion having a tip end, a shroud attached to the tip end, which shroud has an outer surface, and a knife edge attached to an outer surface of the shroud. The knife edge has a pair of cutter blades disposed substantially over an axis of the airfoil portion.

11 Claims, 3 Drawing Sheets

SHROUD HONEYCOMB CUTTER

CROSS-REFERENCE TO RELATED APPLICATION

This application is a continuation-in-part application of Ser. No. 10/774,824, filed Feb. 9, 2004, now U.S. Pat. No. 7,094,023, and entitled SHROUD HONEYCOMB CUTTER, the disclosure of which is incorporated by reference herein as if set forth at length.

FIELD OF THE INVENTION

The present invention relates to gas turbine engines, and more particularly, to a turbine blade for use in such engines.

BACKGROUND OF THE INVENTION

Gas turbine blades are rotating airfoil shaped components in series of stages designed to convert thermal energy from a combustor into mechanical work of turning a rotor. Performance of a turbine can be enhanced by sealing the outer edge of the blade tip to prevent combustion gases from escaping from the flowpath to the gaps between the blade tip and the outer casing. A common manner of sealing the gap between the blade tips and the turbine casing is through blade tip shrouds.

A feature of a typical turbine blade shroud is a knife edge. Depending upon the size of the blade shroud, one or more knife edges may be utilized. The purpose of the knife edge(s) is to engage honeycomb material located on the inner surface of the outer casing to further minimize any leakage around the blade tip. One typical type of knife edge is shown in U.S. Pat. No. 6,491,498 to Seleski et al.

In some shroud configurations, the knife blade is provided with one or more cutting blades which cut the honeycomb material as the blade rotates. Japanese Patent Publication No. 8-303204 illustrates a knife blade having such cutting blades with one of the cutting blades being at an end of the knife edge and the other being removed from the end of the knife edge.

Often, prior art shrouds having knife edge sealing arrangements suffer from a life shortfall as a result of creep initiated by the extra mass of the cutter feature being located at an outer edge of the shroud. Thus, there is need for an improved shroud construction which meets all sealing requirements, and yet does not suffer from creep which shortens the life of the shroud.

SUMMARY OF THE INVENTION

Accordingly, it is an object of the present invention to provide an improved shroud arrangement for a turbine blade.

It is yet another object of the present invention to provide an improved shroud arrangement as above which does not suffer from creep life shortfall.

It is still another object of the present invention to provide a method for forming a shroud arrangement having a knife edge with cutting blades machined therein.

The foregoing objects are attained by the shroud honeycomb cutter of the present invention and the method of making same.

In accordance with the present invention, a turbine blade for use in a gas turbine engine is provided. The turbine blade broadly comprises an airfoil portion having a tip end; a shroud attached to the tip end, the shroud having an outer surface; a knife edge attached to the outer surface of the shroud; and the knife edge having a pair of cutter blades disposed substantially over an axis of the airfoil portion.

Further in accordance with the present invention, a method for manufacturing a turbine blade is provided. The method broadly comprises the steps of forming a turbine blade having an airfoil portion, a shroud attached to a tip end of the airfoil portion, and a knife edge attached to an outer surface of the shroud; determining a minimum bending axis and a maximum bending axis of the airfoil portion; and forming a pair of cutter blades on the knife edge so that the cutter blades are positioned substantially over the minimum bending axis.

Other details of the shroud honeycomb cutter of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
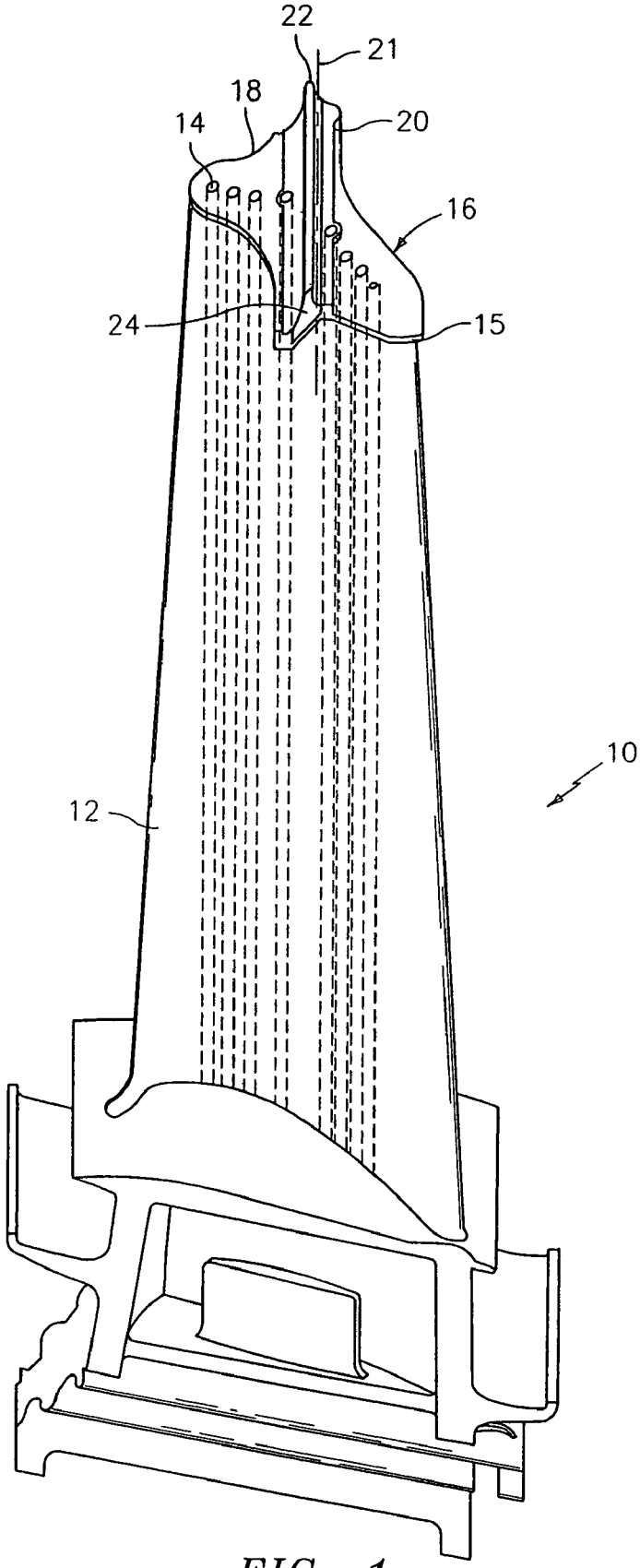
FIG. 1 is a perspective view of a turbine blade having the shroud arrangement of the present invention.

Referring now to the drawings, FIG. 1 illustrates a turbine blade 10 for use in a gas turbine engine. The turbine blade 10 has an airfoil portion 12 which typically contains a plurality of internal cooling passageways 14. The airfoil portion 12 has a tip end 15 to which a shroud 16 is attached. The shroud 16 is shaped to mate with like shrouds on adjacent turbine blades so as to prevent combustion gases from leaking around the turbine blade 10.

As can be seen from FIG. 1, the shroud 16 has an outer surface 18 on which a knife edge 20 is attached. The knife edge 20 is substantially linear in shape and has a longitudinal axis 21 which intersects the chord line of the airfoil portion 12 at an angle. The knife edge 20 may have any desired width and/or height. The knife edge 20 terminates in ends 22 and 24.

The turbine blade 10 with the airfoil portion 12, the shroud 16, and the knife edge 20 may be formed using any suitable technique known in the art. For example, the turbine blade 10 may be a cast blade with the airfoil portion 12 and the shroud 16. The blade 10 has a knife edge 20 which is typically machined. Alternatively, the turbine blade 10 with the airfoil portion 12 may be separately cast from the shroud 16 and the shroud 16 may be separately cast from the knife edge 20. Alternatively, the knife edge 20 may be separately cast from the cutter blades 28, 30. In such a scenario, these components may be assembled in any suitable manner known in the art.

Figure 2:
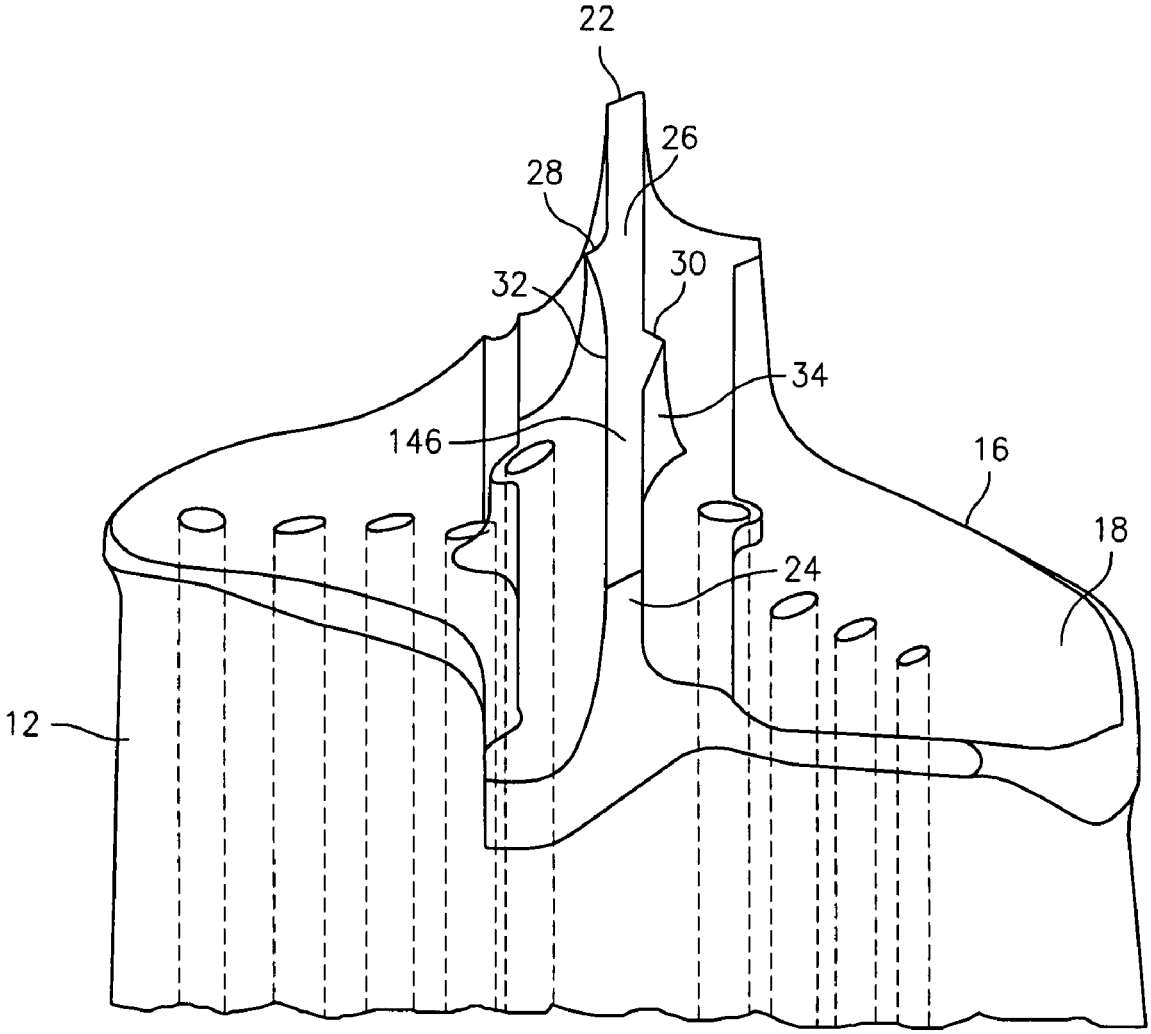
FIG. 2 is an enlarged perspective view of the shroud arrangement of FIG. 1.
Figure 3:
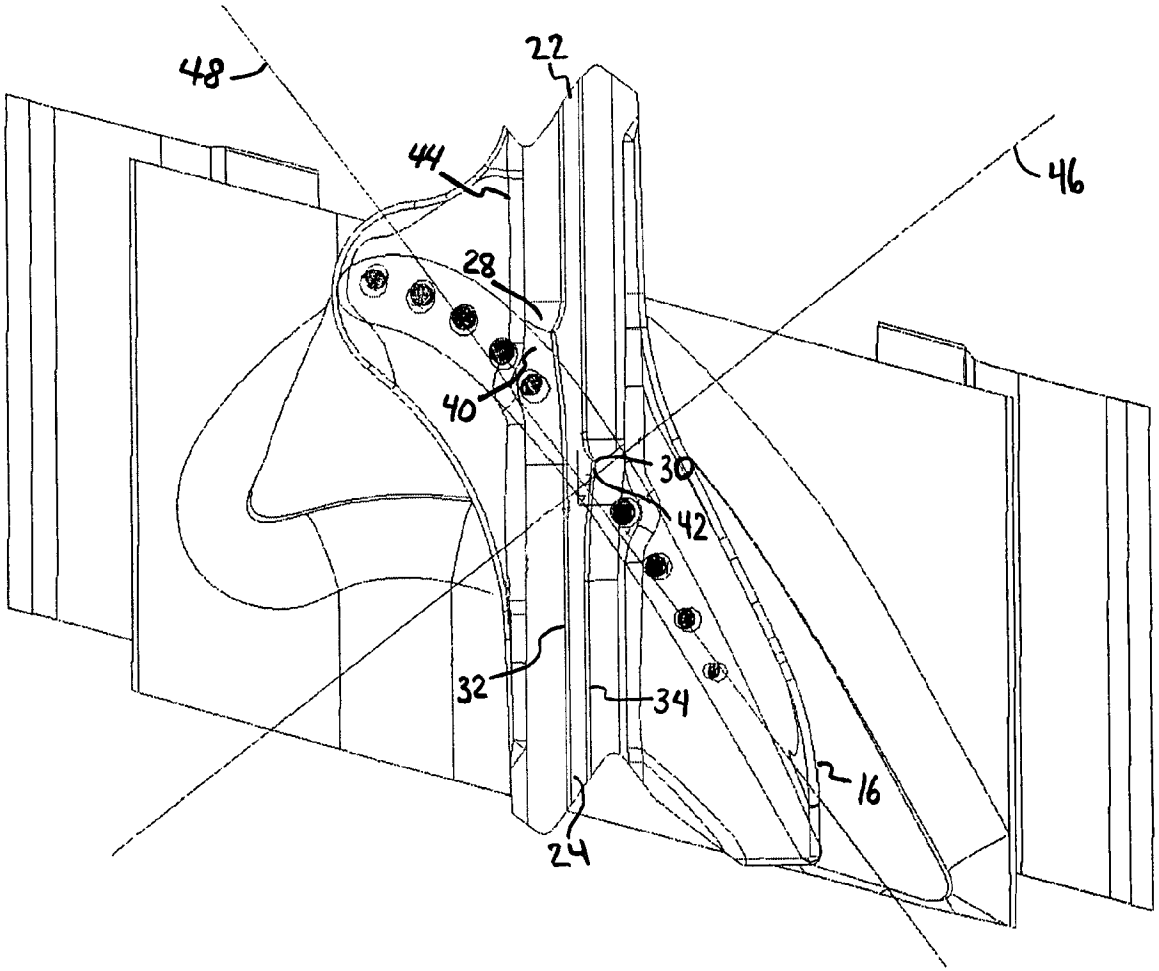
FIG. 3 is a top view of the shroud arrangement of FIG. 1 showing a knife edge with cutter blades in accordance with the present invention.

Referring now to FIGS. 2 and 3, the knife edge 20 has a central region 26 which is spaced from the ends 22 and 24. In this central region 26, a pair of cutter blades 28 and 30 are formed by machining out portions of the knife edge 20. Any suitable machining device known in the art may be used to form the cutter blades 28 and 30. In addition, any suitable casting process may also be used to cast the knife edge 20 and cutter blades 28, 30 as a single component or separately as mentioned above. As can be seen from this figure, the cutter blade 28 protrudes outwardly from a first side 32 of the knife edge 20, while the cutter blade 30 protrudes outwardly from a second opposed side 34 of the knife edge 20. In a preferred embodiment of the present invention, the cutter blade 28 is staggered with respect to the cutter blade 30. Further, both cutter blades 28 and 30 are positioned over the airfoil portion 12.

One of the advantages to machining the cutter blades 28 and 30, instead of forming them via a casting process, is that one is able to get sharper cutting edges. Because the cutter blades 28 and 30 have sharper cutting edges 40 and 42, there is more interaction with the honeycomb (not shown) attached to an inner surface of the outer casing which improves the seal between the outer casing and the turbine blade.

In the context of the present invention, each of the cutter blades 28 and 30 has a cutting edge 40 and 42 respectively which is oriented at an angle, preferably an obtuse angle, with respect to the longitudinal axis 22 of the knife edge 20. Each of the cutter blades 28 and 30 are also positioned substantially over a minimum bending axis of the airfoil portion as discussed below.

As can be seen in FIGS. 2 and 3, machining of the cutter blades 28 and 30 results in the knife edge 20 having a base portion 44 which is wider than the upper edge 146 of the knife edge 20. This is beneficial from the standpoint of reducing the mass of the knife edge 20 while providing the desired cutter blades 28 and 30 with the sharper cutting edges 40 and 42. The cutting blades 28 and 30 in accordance with the present invention are designed to cut the honeycomb (not shown) attached to the inner surface of the outer casing fore and aft.

One of the benefits of the improved knife edge design of the present invention is that the cutter blades 28 and 30 are substantially positioned over the airfoil portion 12 in a manner which best balances shroud load over the airfoil portion. This is advantageous because the mass of the "cutter" is moved to a more balanced area above the shroud. As a result, there is an improvement in preventing creep from shortening the life of the shroud. Additionally, there is an improvement in that the curling which occurs due to the extra-mass of the cutter feature being located at an outer edge of the shroud is avoided. The ability to form the knife edge and the cutter blades by machining is advantageous because the knife edge may be thinner than in other designs, resulting in a lightweight knife edge which also improves shroud creep and airfoil creep.

Balancing of shroud curling and centrifugal force is required in order to maximize the creep life and minimize stresses in a shrouded blade. The weight of the shroud 16 is directly related to the radial force applied upon the turbine blade 10. The radial force will cause a bending moment on a blade cross section whenever the radial line of force passing through the center of mass of the material above the cross section does not pass through the center of mass of the blade cross section.

The moment of inertia, denoted "I", of a section of a part indicates the resistance of that section to bending, i.e. the stiffness. For any given section there is an axis 46 about which the moment of inertia is maximum ("Imax") and an axis 48 about which the moment of inertia is minimum ("Imin"). The location of Imax axis 46 and Imin axis 48 may be determined using any one of several techniques known to one of ordinary skill in the art. For example, one may employ precision instruments to correlate the location of each axes 46, 48 to coordinate points of the airfoil portion or, in the alternative, utilize a computer implemented process to determine the location of each axes 46, 48. These axes 46, 48 will be perpendicular to one another. Generally, the moment created by a force about an axis is equal to the force multiplied by the distance to the axis. This moment induces a stress equal to the moment times the distance to the stress location divided by the moment of inertia.

In a shrouded blade, the shroud material that extends beyond the airfoil tip section to which it is attached creates a moment on the airfoil tip section 15. The combined force of the concave and convex shroud material should ideally align with the intersection of Imin axis 48 and Imax axis 46. This alignment balances the moments on the airfoil tip section 15 so that the bending forces cancel and only a radial force acts on the airfoil section. Achieving perfect balance is not always practical due to aerodynamic requirements or other design requirements. If there is a resultant moment it is preferred that the moment be created about the Imax axis 46 to minimize the bending induced stresses. This means the center of mass of the shroud 16 should be as close to the Imin axis 48 as possible. When adding features to a knife edge rail, the features, e.g., cutter blades 28, 30, should have their center of mass aligned with the Imin axis 48 as closely as possible for the aforementioned reasons.

Additionally, mass that is cantilevered out from the airfoil section, such as material at the tangential extremes of a knife edge seal, will creating a bending moment on the material that supports it. If this force it too great the extreme ends will creep and potentially rupture. A cutting feature 28, 30 that consists of positive material placed at the extreme end of a shroud knife edge 20 will increase the bending moment about the Imin axis 48 of the airfoil 12 and about the supporting material. This should also be avoided and any positive material required should be placed as proximate to Imin axis 48 as possible. If material is removed out, the material should be removed as close to the extreme ends as possible. Removing material will reduce the pull force of the cantilevered section, and reduce the bending moment and corresponding stress. A cutter feature 28, 30 that is created by negative material should be placed towards or at the extremes of the shroud overhang, and the Imin axis 48, to reduce the pull by the maximum amount. Even though a negative material cutter feature will provide the most benefit at the greatest distance from the Imin axis 48, the negative material cutter feature will not provide the most benefit at any location along the shroud knife edge 20 because removing material will always reduce the radial pull force. This is in contrast to adding a positive material cutter feature.

Where it is not possible to completely balance force so that no bending is created, the Imin axis 48 is the preferred axis for aligning pull forces. This is because forces on this axis will be trying to bend the blade about the Imax axis 46, which will induce the lowest stress due to bending. If the moment is created about the Imin axis 48 the part is least able to resist the bending force, which will cause the most distortion and the highest induced stresses.

In operation, the turbine blade 10 is rotated. As the temperature of the engine arises, the cutter blades 28 and 30 interact with the honeycomb attached to the outer casing to maintain a seal which prevents the leakage of combustion gases around the turbine blade 10.

It is apparent that there has been provided in accordance with the present invention a shroud honeycomb cutter which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A turbine blade for use in a gas turbine engine, said turbine blade comprising:

an airfoil portion having a tip end;

a shroud attached to said tip end, said shroud having an outer surface;

a knife edge attached to said outer surface of said shroud; and said knife edge having a pair of cutter blades disposed substantially over an axis of said airfoil portion, wherein said pair of cutter blades are disposed substantially over a minimum bending axis of said airfoil portion.

2. The turbine blade of claim 1, wherein said pair of cutter blades each have a center of mass positioned substantially over said axis.

3. The turbine blade of claim 1, wherein said pair of cutter blades each have a center of mass disposed substantially over said minimum bending axis of said airfoil portion.

4. The turbine blade of claim 1, wherein each said cutter blade has a single pointed edge.

5. The turbine blade of claim 4, wherein each said pointed edge is formed by two intersecting surfaces with each of said surfaces being at an angle with respect to a longitudinal axis of said knife edge.

6. The turbine blade of claim 1, wherein said knife edge has an upper edge and a base portion wider than said upper edge.

7. A method for manufacturing a turbine blade comprising:

forming a turbine blade having an airfoil portion, a shroud attached to a tip end of said airfoil portion, and a knife edge attached to an outer surface of said shroud;

determining a minimum bending axis and a maximum bending axis of said airfoil portion; and forming a pair of cutter blades on said knife edge so that said cutter blades are positioned substantially over said minimum bending axis.

8. The method according to claim 7, wherein forming comprises removing a portion of material from said knife edge to form said pair of cutter blades.

9. The method according to claim 7, wherein forming comprises adding a portion of material to said knife edge to form said pair of cutter blades.

10. The method according to claim 7, wherein said forming a pair of cutter blades on said knife edge comprises forming each said cutter blade with a single sharp edge formed by two intersecting surfaces at an angle with respect to a longitudinal axis of said knife edge.

11. The method according to claim 7, further comprising machining the knife edge so that a base portion of said knife edge is wider than an upper edge of said knife edge.

* * * * *